US005376990A

United States Patent [19]

Savage

[11] Patent Number: 5,376,990

[45] Date of Patent: Dec. 27, 1994

[54] METHOD AND APPARATUS FOR PROMOTING UNIFORM AGING AND EXTENDING PHOTOCONDUCTOR LIFE

[75] Inventor: Edward C. Savage, Webster, N.Y.

[73] Assignee: Xerox Corporation, Stamford, Conn.

[21] Appl. No.: 152

[22] Filed: Jan. 4, 1993

[51] Int. Cl.[5] ..... G03G 21/00

[52] U.S. Cl. ..... 355/208; 355/30; 355/212; 355/313

[58] Field of Search ..... 355/205, 207, 208, 211, 355/212, 282, 285, 313, 314, 30

[56] References Cited

U.S. PATENT DOCUMENTS

| | | | |
|---|---|---|---|
| 3,843,407 | 10/1974 | Thorp | 134/6 |
| 4,522,483 | 6/1985 | Matsumoto et al. | 355/313 |
| 4,595,602 | 6/1986 | Schank | 427/76 |
| 4,599,286 | 7/1986 | Limburg et al. | 430/59 |
| 4,766,403 | 8/1988 | Sasaki et al. | 355/212 |
| 5,114,818 | 5/1992 | Yu | 430/97 |

FOREIGN PATENT DOCUMENTS

| | | | |
|---|---|---|---|
| 0224885 | 12/1984 | Japan . | |
| 0248967 | 10/1990 | Japan . | |
| 0140765 | 5/1992 | Japan . | |
| 0174454 | 6/1992 | Japan | 355/212 |
| 0240865 | 8/1992 | Japan . | |

*Primary Examiner*—Robert B. Beatty

[57] ABSTRACT

An electrophotographic imaging device including an photoconductive imaging member having a surface extending approximate to devices generating life degrading contaminants. The printing machine includes a driving unit which continues to drive the imaging member during power down and standby modes, and other critical periods, so as to extend the life of the imaging member.

5 Claims, 1 Drawing Sheet

Figure 1:
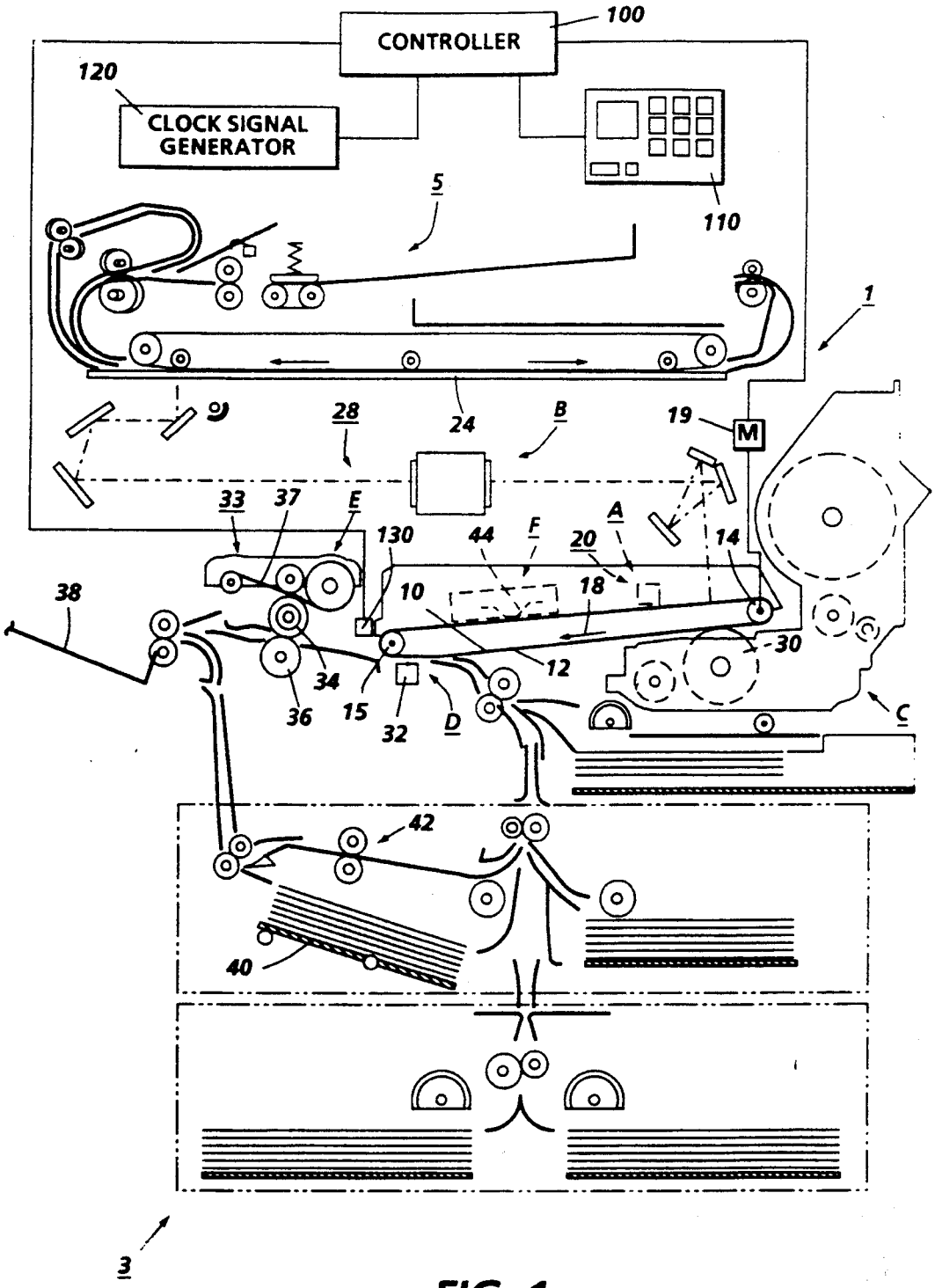

METHOD AND APPARATUS FOR PROMOTING UNIFORM AGING AND EXTENDING PHOTOCONDUCTOR LIFE

This invention relates generally to promoting the uniform aging and extending imaging member life in printing machines and, more particularly, to a method and apparatus for promoting the uniform aging and longevity of the photoconductive imaging member of an electrophotographic printing machine.

The following patents and patent applications are hereby incorporated by reference thereto:

U.S. Pat. No. 3,843,407, issued Oct. 22, 1974 to Thorp, and assigned to Xerox Corporation:

U.S. patent application Ser. No. 08/000,343 now U.S. Pat. No. 5,319,430 filed on the same date as the present application, entitled FUSER MECHANISM HAVING CROWNED ROLLS, assigned to Xerox Corporation; and U.S. patent application Ser. No. 08/000,151 now U.S. Pat. No. 5,327,203 filed on the same date as the present application, entitled IMPROVED WEB RELEASE AGENT SYSTEM FOR A HEAT AND PRESSURE FUSER, assigned to Xerox Corporation.

Generally, electrophotographic printing machines involve devices and methods for the formation and development of electrostatic latent images on an imaging surface of photoconductive member. The developed image is ultimately transferred and fixed on a substrate, such as paper, Mylar and the like.

The photoconductive member is usually imaged by uniformly electrostatically charging the photoconductive surface in a dark environment and then exposing the charged portion of the member to a pattern of electromagnetic radiation such as light, to selectively dissipate the charge in the illuminated areas of the member to thereby record an electrostatic latent image on the imaging surface. The electrostatic latent image is then developed with a developer composition which contains toner particles attracted to the photoconductive member in conformance with the latent image. The resulting toner image formed on the photoconductive member can then be transferred to the substrate.

The photoconductive members generally include either single or multiple layered devices comprising homogeneous or heterogeneous inorganic or organic compositions which are insulators but when in the presence of various forms of electromagnetic radiation (e.g., visible light) become conductive. These layers are commonly supported on a conductive substrate. The present invention relates to imaging members formed from, either or both, organic and inorganic compositions.

As would generally be expected, the quality of imaging produced by an electrophotographic printing machine is, in large measure, a function of the quality or condition of the photoconductive member used. Particularly, it has been determined that a photoconductive member of the type to which this invention relates ages. That is, for example, its characteristics change over time and use so that its charge and discharge properties change perceptively. This aging process is generally promoted or advanced by certain factors, such as heat or the presence of certain gases often found in the areas proximate to the photoconductive surface in such printing machines. These gases include, by way of example, ozone and nitrous oxide compounds, in the area around the photoconductive surface.

Nonuniform aging of the photoconductive member gives rise to problems in the performance and utility of printing machines having a photoconductive member exhibiting such characteristics. For example, nonuniform aging of adjacent portions of the photoconductive surface can result in images which vary along their length, width, or both and which in most uses is unacceptable. Likewise, nonuniform aging of nonadjacent portions of the photoconductive surface in imaging member, can result in images at these portions which are varied from each other. This is also generally unacceptable. Thus, when the imaging member becomes nonuniformly aged so as to be noticeable to the users thereof, replacement of the photoconductive member is generally the only solution.

It is well known in the art that the apparatus frequently employed in electrophotographic printing machines for producing images also create by-products or conditions (hereinafter referenced as aging factors) which promote the aging of the photoconductive member. For example, the charge generating devices often used in electrophotographic printing machines to charge and transfer images from the photoconductive member to a substrate are usually corona generating devices. Corona generating devices of this type also tend to form or emit certain gases, such as the aforementioned ozone and nitrous oxide compounds.

These gases tend to chemically react with the constituents of most, in not all, commercially available photoconductive members so as to cause portions of the member not to hold a charge. In this case, the contrast of images transferred to the substrate is greatly reduced. In the case, where the effect is nonuniform, an image may be formed having deletion therein.

Further, these machines, to fix images to the substrates, frequently employ heated elements such as a quartz lamp. These heating elements, besides fusing images also tend to increase the heat level in the machine, particularly proximate to the fusing area. This, of course, is another one of the aforementioned aging factors. In this case, the problem is primarily a mechanical and physical problem. The increased heat, when the photoconductive member is stopped, for example, over a roller or against a knife edge, tends to cause the member to conform or to set. Thus, the photoconductive member becomes permanently deformed so that high quality imaging is essentially impossible. In other cases, the increased temperature will cause a change in the electrical properties of the photoconductive member, thus, altering the imageability of the photoconductive member.

The problem of setting of the photoconductive member tend to be most often associated with flexible photoconductive members (e.g., belts), although it can occur, to an extent, in relatively nonflexible photoconductive members, such as a drum. The problems are also sometimes transient, so that after a number of cycles, generally, in excess of the number necessary for warmup and system checking, the problem dissipates. Nevertheless, it is a condition which many users find troublesome and unacceptable.

These problems have become even more common, as there has been an ever increasing need and desire to contain printing machines and their components, including the photoconductive members, within a more limited space to increase their overall utility and versatility to purchasers and users thereof. This is particularly true in so-called low volume and mid-volume printing machines of the type to which this invention relates (e.g., generally, printing machines which produce between 10 and 65 copies per minute).

Various attempts have been made to protect or otherwise change the composition of the photoconductive imaging members to promote their useful life for these reasons. For example, some printing machines include an apparatus for ensuring that every time the belt is stopped it has a position which is different from the last time that it was stopped. The Xerox 5028 machine is an example of such a product.

Another method used in some printing machines involves stopping the photoconductive member so that an area not used in printing (e.g., the seam joining a belt photoconductive member together) is positioned closest to the areas that promote or advance the aging of the photoconductive surface. Other techniques have been employed, such as heat shields and protective coatings or compositions.

Thus, in the normal operation of an electrophotographic printing machine, the photoconductive surface disposed on a conductive substrate, formed often as a belt or drum, is cycled through image processing stations and exposed to the aging factors which promote the aging of the imaging member. This is an expected and tolerable aging, as the machine is functioning in the intended manner. However, these printing machines are rarely continuously used. It is common for them to sit idle for relatively long periods of time in a ready mode (awaiting next instruction to print an image) and a power saving mode where most of the machine stations are inactivated or otherwise turned down to reduce power consumption. For example, the corona generators are generally disabled, and the fuser station in some machines is disabled (i.e., power is cut off and the fuser station cools), while in others the power is reduced to lower the fuser station temperature to a standby temperature to enable relatively rapid return to process temperature.

The ready mode and the power saving modes, however, tend to exacerbate the aging process of the photoconductive member. In these modes the photoconductive member is also stopped with portions remaining adjacent areas which promote aging. The mere turning off of the corona generator and the reduction in heat of the fuser does not immediately dissipate all the aging factors associated with these devices when operating. Thus, a problem exists in that the nonuniform aging of the belt is promoted. Further, since the duration of power saving and ready modes is usually not uniform, even the stopping of the member at different locations is not without problems. Likewise, attempts to park unused portions of the member at so-called critical areas where the aging factors may be more prevalent is not adequate. Simply, portions of the photoconductive member, which are used are, of course, adjacent the unused areas, and these used areas will age at a nonuniform rate relative to the remainder of the member. Thus, there exists a need for promoting the uniform aging of photoconductive members and, thus, extend the useful thereof.

The following patents may be relevant to this invention: U.S. Pat. No. 4,599,286 to Limburg et al., issued Jul. 8, 1986; U.S. Pat. No. 4,595,602 to Schank, issued Jun. 17, 1986; U.S. Pat. No. 5,114,818 to Yu, issued May 19, 1992; U.S. Pat. No. 3,843,407 to Thorp, issued Oct. 22, 1974.

These references may be briefly summarized as follows:

U.S. Pat. No. 4,599,286 discloses an electrophotographic imaging member which has a charged generation layer and a charged transport layer. The transport layer is comprised of an aromatic amine charged transport molecule in a continuous polymeric binder phase and a chemical stabilizer selected from the group consisting of certain nitrone, isobenzofuran, hydroxyaromatic compounds and mixtures thereof. The chemical stabilizer is included in this electrophotographic imaging member to promote the uniform aging of the photoconductive member and to resist decay by virtue of the heat and other ambient features proximate the photoconductive surface in use.

U.S. Pat. No. 4,595,602 discloses another composition for forming a coated electrophotographic imaging member with a protective layer to promote the useful life of a photoconductive member.

U.S. Pat. No. 5,114,818 discloses an electrophotographic imaging apparatus including an organic electrophotographic imaging member having at least one arcuate surface, and a thin heat shield having at least one, heat reflective metallic surface interposed between the heat fuser roll and the adjacent arcuate surface. The metallic surface interposed between the heat fuser roll and the adjacent arcuate surface has a concentric arc portion with the arcuate surface of the imaging member. The heat shield is intended to diffuse heat from the heat fuser roll.

U.S. Pat. No. 3,843,407 discloses a reversing drive for a photoconductive surface. Specifically, the device is to reverse the direction of the photoconductive member (a drum) to draw material from under the cleaning blade and also to reduce incidents of a cleaning blade tucking under so as to be out of position. The reversal movement of the photoconductive member as stated need not be long to achieve the desired results, and, in fact, the distance found to be effective were on the order of $\frac{1}{4}$ to $\frac{1}{2}$ inch. The reversal of movement according to this patent was intended to be periodic so that upon stoppage of the device the drum would be reversed for a short distance, although not necessarily at every stop. It is further disclosed that a spring or a secondary motor could be employed to accomplish the reverse rotation of the drum supported photoconductive member.

In accordance with one aspect of the present invention, a method of improving the life of an imaging member used in a printing machine, is provided comprising the steps of: sensing a reduction in power furnished to the printing machine, generating a signal in response to the sensing step, and moving the imaging member, in response to the generating step, a preselected duration of time. The moving step may comprises the steps of enabling a secondary drive mechanism and disabling a primary drive mechanism for the imaging member, and the preselected duration of the moving step is of a sufficient length to permit substantial dissipation of factors proximate the imaging member reducing the life thereof. The moving step may also move the imaging member at a velocity less than the velocity at which the imaging member is moved by the primary drive mechanism, while this aspect of the invention can further include the steps of detecting the factors proximate the imaging member effecting the life thereof and generating, in response to the sensing step, signals to stop and start the moving step. In addition, this aspect of the invention can further comprise one or more of the following steps: reducing power to the secondary drive mechanism to terminate said moving of time step after completion of the preselected duration; detecting standby condition wherein power to the printing machine is reduced; generating a power saver signal in response to said detecting step; actuating a secondary drive mechanism responsive to the power saver signal; and driving the imaging member in response to actuation of the secondary drive mechanism for a second preselected duration of time.

According to another aspect of the present invention, there is provided a method for cycling a photoconductive imaging member in an electrophotographic printing machine in a power saving mode to extend the life thereof, comprising the steps of: sensing a factor reducing the life of the photoconductive imaging member during a nonprinting state of the electrophotographic printing machine; generating a standby signal in response to the sensing step; and actuating a photoconductive imaging member drive mechanism responsive to the standby signal, to drive the photoconductive imaging member during the nonprinting state for a predetermined duration of time.

In accordance with yet another aspect of the invention, there is provided an electrophotographic printing machine of the type having a photoconductive imaging member, which comprises means for sensing a reduction in power consumed by the printing machine and generating a power down signal in response thereto; and means, responsive to the power down signal for driving the photoconductive member a predetermined duration of time to extend the life of the photoconductive imaging member. The driving means can provide indexing of the photoconductive member during the predetermined duration of time to position various portions of the photoconductive member at different locations in the printing machine, and this aspect of the invention can further comprise means for detecting an aging factor proximate the photoconductive member and means, responsive to the detecting means, for generating control signals to energize and deenergize the drive means. Further, the printing machine may have a heat source and the detecting means may comprise a heat sensor positioned between the heat source and the photoconductive member. The drive means of this aspect of the invention may also provide indexing of the photoconductive imaging member at a relatively slow periodic rate during the predetermined duration of time.

Other aspects of the present invention will become apparent as the following description proceeds and upon reference to the Figure which shows a schematic elevational view of an illustrative electrophotographic printing machine incorporating the features of the present invention.

While the present invention will be described in connection with the preferred embodiment thereof, it will be understood that it is not intended to limit the invention to that embodiment. On the contrary, it is intended to cover all embodiments, modifications, and equivalents as may be included within the spirit and scope of the invention as defined by the appended claims. For a general understanding of the features of the present invention, references should be made to the figure. In the figure, like numerals have been used to identify identical elements.

The FIGURE schematically depicts an illustrative electrophotographic printing machine of the type in which the present invention may be employed.

Specifically, printing machine 1 has both a copy sheet handling system 3 and a document handling system 5 for transporting sheets of material such as paper, Mylar and the like, to and from processing stations of the machine 1. The machine 1, has conventional imaging processing stations associated therewith, including a charging station A, an imaging/exposing station B, a development station C, a transfer station D, a fusing station E, and a cleaning station F. It will be understood that a conventional finishing station (not shown) could easily be included for use with the illustrative printing machine 1. The machine 1 has a photoconductive imaging member, in this instance belt 10 with a photoconductive layer 12. The belt 10 is entrained about a drive roller 14 and a tension roller 15. The drive roller 14 functions to drive the belt in the direction indicated by arrow 18. The drive roller 14 is itself driven by a motor 19 by suitable means, such as a belt drive.

The operation of the machine 1 can be briefly described as follows:

The photoconductive belt 10 is charged at the charging station A by a corona generating device 20. The charged portion of the belt is then transported by drive roller 14 to the imaging/exposing station B where a latent image is formed on the belt 10 corresponding to the image on a document positioned on a platen 24 via the light lens imaging system 28 of the imaging/exposing station B. It will also be understood that the light lens imaging system can easily be changed to an input/output scanning terminal or an output scanning terminal driven by a data input signal to likewise image the belt 10.

The portion of the belt 10 bearing the latent image is then transported to the development station C where the latent image is developed by electrically charged toner material from a magnetic developer roller 30 of the developer station C. The developed image on the belt is then transported to a transfer station D where the toner image is transferred to a copy sheet transported in the copy handling system 3. In this case, a corona generating device 32 is provided to attract the toner image from the photoconductive belt 10 to the copy sheet. It will also be understood that the development station may be changed to accommodate a variety of developer materials such as single component or non-magnetic types.

The copy sheet with image thereon is then directed to the fuser station E. The fuser at station E includes a release agent delivery system 33, a heated fuser roll 34 and backup pressure roll 36. The heated fuser roll and pressure roll cooperate to fix the image to the substrate. The release agent delivery system 33 delivers release agent to the fuser roll 34 from a release agent impregnated web 37 to inhibit offset of images printed on substrates by the printing machine 1. The copy sheet then, as is well known, may be selectively transported to an output tray 38 or along a selectable duplex path including apparatus for buffered duplexing and for immediate duplexing (i.e., tray 40 and path 42 in the case of the illustrative printing machine of FIG. 1). The portion of the belt 10 which bore the developed image is then transported to the cleaning station F where residual toner and charge on the belt is removed by a blade edge 44 and a discharge lamp (not shown). The cycle is then repeated.

Finally, as will be also understood, the control signals for the sheet handler operation are provided by controller 100, which is preferably a conventional microprocessor system, as exemplified, for example, in U.S. Pat. No. 4,475,156. It is contemplated that the controller controls all machine steps and functions described herein, as well as that of any and/or all apparatus and devices associated with the electrophotographic printing machine 1. A control panel 110 is also provided so as to permit users of the printing machine 1 to enter instructions, including a power off instruction, and otherwise interact with the machine through the controller 100.

The invention will now be discussed in greater detail with continuing reference to the Figure. As can be seen, various corona generating devices are commonly disposed about a photoconductive surface in an electrophotographic printing machine. Here, corona generating devices 20 and 32, are positioned at the charging station A and the transfer station D to operate on the belt 10. These corona generating devices, as previously described, are necessary to the operation of the printing machine 1, while also producing aging factors, generally gases, which tend to become entrapped within the components, such as the cleaning station F of the printing machine 1, as well as the covers and components generally associated with such printing machines.

It will be understood and appreciated that electrophotographic printing machines generally employ similar corona generating devices in similar locations along a photoconductive imaging surface for substantially the same purposes, as well as, in other positions and for other purposes. For example, many such printing machines also include a pre-transfer corona generating device (i.e., positioned between the developer station C and the transfer station D) to condition toner for transfer and/or a corona generating discharge device to discharge the photoconductive surface after passing the cleaning station F and prior to the charging station A, instead of the discharge lamp (not shown) which is preferred in the illustrative printing machine 1.

Likewise, it is seen that the heated fuser roll 34 is positioned relative close proximity to the photoconductive surface 12 of the belt 10 as it passes over tension roll 15. For example, the distance between the photoconductive surface and heated fuser roll ranges from approximately 6 inches (152.94 mm) to 8 inches (203.2 mm). In other printing machines, the distances may be greater, but the effect of the aging factor due to the heat of the fuser roll, while lessened, is still problematic, as fusing temperatures are generally at least 437° F. (225° C.).

Thus, to reduce the effect of the aging factors during periods of inactivity of the printing machine 1, the present invention provides that the controller, as is common, is connected to a clock signal generator 120 and to the drive apparatus of the photoconductive imaging member, motor 19. The controller 100, in addition to generating signals to actuate the motor 19 to drive the photoconductive member, belt 10, during printing operations of the printing machine 1, also generates actuation signals at other predetermined times and/or conditions, as will be further explained below. The controller 100 is also connected to sensor means, in this instance, a thermistor 130 disposed between the heated fuser roll 34 and the belt 10. Thus, in response to predetermined informational signals from the control panel 110, the clock signal generator 120, or the thermistor 130, the controller can implement a predetermined actuation signal to the motor 19. Further, the controller 100 can also implement a control signal to the motor 19 to inactivate the motor 19 and cease the movement of the belt 10.

Thus, the controller, after one or more of the preselected signals are received from one of several informational signal sources, generates a control signal to drive the belt 10. For example, the preselected signal can include ones from the control panel 110 indicating a power off condition (i.e., the power is to be turned off). In this case, for safety and other considerations, two forms of power off could be made available to the user so that an immediate and complete power down could also be enabled as well as one where, prior to the controller initiating a complete cessation of power down, the controller 100 initiates a power off routine. In such power off routine, it is preferred that the power is removed from essentially all components of the machine 8, except the motor 19, which is driven according to a power off mode, as will be described below. Further, it will also be appreciated that for safety and other reasons known interlock type mechanisms and sensors can be employed to override the mode to be described.

A second informational signal source to prompt control signals to the motor 19 could also include the clock signal generator 120. In this embodiment, the clock signal generator 120 generates a stream of signals to the controller 100 to provide timing for the printing machine 8. Thus, when a sufficient number of timing signals have occurred between ordinary operations (i.e., printing of images on a sheet). It will be understood that a buffer or other counting or accumulating device can be employed for counting purposes. In this case, the controller 100 enters a power saver routine and initiates control signals to the motor 19 to drive the belt 10 according to a predetermined power saver mode.

A third informational signal source to prompt control signals to the motor 19 could also include the thermistor 130 which is situated to provide information regarding the temperature proximate the belt. In this manner signals can be provided to the controller 100 to provide a cycling routine signal to the motor 19 in response to a predetermined informational signal indicative that the temperature is above a certain critical level. In addition, the informational signal from the thermistor can also be coupled with the informational signal from the clock signal generator 120 so that the predetermined condition indicated is the occurrence of a critical temperature for a period of time. In response to the predetermined signals, the belt 10 is moved, by the actuation of the motor 19 in response to control signals from the controller 100 in a critical level ready mode cycle. It will be understood that the ready cycle can also be implemented through the use of the clock signal generator which would measure passage of time to indicate a critical ready level again after the passage of time since the last image made. This is, however, not believed to be as efficient or beneficial as the previously discussed heat sensing device.

In use, the informational signals from the signal generating means (i.e., the control panel 110, the clock signal generator 120, and the thermistor 130) provide input to the controller 100 as to the status of the printing machine 8. In response to these signals, the controller 100 actuates the motor 19. For example, during a power off mode prior to the control signal from the controller to totally cut power to the entire printing machine 1, the belt is driven so as to cycle the belt 10. In this manner, the aging factors (the elevated temperature and the gases) can be dissipated or significantly reduced prior to cessation of the cycling of the belt 10. It will also be appreciated that cycling the belt tends to more evenly distribute the aging factors across the portions of the belt 10, as it is moving relative to the critical areas.

It is preferred that the belt cycle modes for power off, power saver, and critical level modes be essentially the same, although in certain instances the routine may be different to account for the differences in the constituent elements and the construction of the printing machine. In any event, the cycling routine need not be for an excessive duration, as the dissipation of heat and of ozone is relatively rapid in these devices. It is believed that fifteen (15) minutes is generally sufficient time for cycling in accordance with this invention for the printing machine described herein, and ten (10) minutes is preferred. It will be understood and appreciated that additional or shorter cycle times may be required to account for differences among printing machines.

It will also be understood that the cycling in accordance with this invention does not have to be at the rate at which the belt is cycled during printing operations. In fact, it is preferred that the rate be significantly slower, as it reduces the noise level and enables the use of separate inexpensive means for driving the belt 10. Moreover, it is also preferred that the cycling be of a periodic nature during theses routines, that is the belt is driven in a series of partial rotations (e.g., rotated or indexed and parked one quarter of its length every 2 minutes during a 10 minute cycle out routine).

Moreover, the cycling of the belt in these modes does not have to be in the same direction. Other features, which may be added and which are contemplated herein, may include a separate drive system for the cycling modes to promote uniform aging. That is a motor separate from motor 19 could be employed to drive the belt. An example of a mechanism to separately drive the photoconductive member in accordance with the present invention is disclosed and described in U.S. Pat. No. 3,843,407, incorporated by reference herein. Additionally, it will be appreciated that the driving means employed during the cycling of the photoconductive member of the present invention could be a spring actuated or fly wheel actuated arrangement of a known type. Thus, the energy to drive the photoconductive member during the cycling routines could be accumulated during the ordinary use of the printing machine in printing.

Another feature of the present invention, as embodied in the printing machine reduced to practice is that the fuser assembly is commonly driven with the photoconductive member, so that indexing the belt 10, as described in the foregoing also indexes the fuser roll 34 and the pressure roll 36. As described in U.S. patent application Ser. No. 08/000,343 now U.S. Pat. No. 5,319,430 incorporated herein by reference, rotation of the fuser roll against the release agent impregnated web 37 causes the transfer of release agent, preferably silicone oil, to the fuser roll. Thus, the present invention also provides additional release agent to the fuser roll 34 during the cycling modes of the belt 10.

In this embodiment, the application of additional release agent to the fuser roll 34 promotes its longevity, as well. The fuser roll 34 and the pressure roll 36 are preferably formed of materials and shaped, as described in U.S. patent application Ser. No. 08/000,151 now U.S. Pat. No. 5,327,203 also incorporated herein by reference. In certain instances of prolonged standby or even power down (e.g., over night or over a weekend) and, particularly, when the power down or standby occurs after a relative long and substantially uninterrupted segment of copying (e.g., on the order of several hundred or more), when the fuser roll can become relatively free of release agent, the fuser roll 34 and the pressure roll 36 can bond or adhere to each other in the nip. Thus, when the printing machine is restarred, parts of the surface of the fuser roll 34 can tear away from the surface. This results in unfused areas on sheets produced and requires the replacement of the fuser roll and/or the pressure roll. The indexing or cycling of the fuser roll 34 in accord with this invention, alleviates this problem, as additional release agent is applied to the fuser before it remains stationary with respect to the pressure roll. In this case, it is believed that the silicone oil release agent acts as a buffer to substantially eliminate the mechanical and/or chemical tendencies of the pressure roll 36 and the fuser roll 34 to bond or adhere to one another.

In recapitulation, a method and apparatus which promotes the uniform aging of photoconductive members and which also promotes their longevity has been disclosed. Specifically, the method comprises the steps of sensing a cycle down condition, generating a cycle down signal in response to the sensing step, and driving the photoconductive imaging member in response to the generating step to drive the photoconductive imaging member on a predetermined cycle so as to promote the uniform aging of the photoconductive imaging member. The method can further comprise the steps of sensing the aging factors proximate the belt and generating, in response to the sensing step, signals to stop and start the driving step, wherein the driving step is also responsive to the step of sensing the aging factors. In this manner the photoconductive imaging member tends to be relatively uniformly aged, as the surface tends to be exposed in substantially equal measure to the aging factors.

It is, therefore, apparent that there has been provided in accordance with the present invention, a method and apparatus for promoting the uniform aging of photoconductive members that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An electrophotographic printing machine of the type having a photoconductive imaging member, comprising:

means for sensing a reduction in power consumed by the printing machine and generating a power down signal in response thereto; and means, responsive to power down signal for driving the photoconductive member a predetermined duration of time to extend the life of the photoconductive imaging member, said driving means indexes the photoconductive member during the predetermined duration of time to position various portions of the photoconductive member at different locations in the printing machine;

means for detecting an aging factor proximate the photoconductive member; and means, responsive to said detecting means, for generating control signals, to energize and deenergize said driving means.

2. The printing machine of claim 1, further including a heat source, wherein said detecting means comprise a heat sensor positioned between the heat source and the photoconductive member.

3. The printing machine of claim 1, wherein said driving means indexes the photoconductive imaging member at a relatively slow periodic rate during the predetermined duration of time.

4. A method of improving the life of an imaging member used in a printing machine, comprising:

sensing a reduction in power furnished to the printing machine;

generating a signal in response to said sensing step;

moving the imaging member, in response to said generating step, a preselected duration of time, said moving step comprises the steps enabling a secondary drive mechanism, and disabling a primary drive mechanism for the imaging member, wherein said moving step moves the imaging member at a velocity less than the velocity at which the imaging member is moved by the primary drive mechanism;

detecting the factors proximate the imaging member effecting the life thereof;

generating, in response to said detecting step, signals to stop and start said moving step;

reducing power to the secondary drive mechanism to terminate said moving step after completion of the preselected duration of time;

detecting a standby condition wherein power to the printing machine is reduced;

generating a power saver signal in response to said detecting step;

actuating the secondary drive mechanism responsive to the power saver signal; and driving the imaging member in response to actuation of the secondary drive mechanism for a preselected duration of time.

5. A method for cycling a photoconductive imaging member in an electrophotographic printing machine in a power saving mode to extend the life thereof, comprising the steps of:

sensing a factor reducing the life of the photoconductive imaging member during a nonprinting state of the electrophotographic printing machine;

generating a signal in response to said sensing step; and actuating a photoconductive imaging member drive mechanism responsive to the signal, to drive the photoconductive imaging member during the nonprinting state for a predetermined duration of time.

* * * * *